United States Patent [19]

Rhyner

[11] Patent Number: 4,722,376

[45] Date of Patent: Feb. 2, 1988

[54] DUAL PURPOSE POUCHES FOR IDENTIFICATION CARDS

[75] Inventor: Edison L. Rhyner, Chicago, Ill.

[73] Assignee: Transilwrap Company, Inc., Chicago, Ill.

[21] Appl. No.: 862,464

[22] Filed: May 12, 1986

[51] Int. Cl.[4] ..... A45C 11/18; G09F 3/02

[52] U.S. Cl. ..... 150/147; 40/1.5; 40/10 D; 40/159; 40/626; 206/37; 206/39; 206/45.34; 229/75

[58] Field of Search ..... 150/147–149, 150/145, 146; 206/37, 38, 39, 39.7, 45.33, 45.34, 39.5; 40/10 R, 10 D, 159, 1.5, 158 B, 625, 626; 229/72, 75; 283/75, 76; 428/13, 77, 542.8; 383/38; 156/217; 493/261, 920

[56] References Cited

U.S. PATENT DOCUMENTS

| | | | |
|---|---|---|---|
| 2,258,316 | 10/1941 | Buxton | 150/147 |
| 2,767,756 | 10/1956 | Niles | 206/39 |
| 3,295,235 | 3/1967 | Tauber | 40/1.5 |
| 3,360,027 | 12/1967 | Price | 150/147 X |
| 3,363,346 | 1/1968 | Wittboldt | 283/75 X |
| 3,655,494 | 4/1972 | Buzzell | 40/159 X |
| 4,037,716 | 7/1977 | Marks | 206/38 |
| 4,058,251 | 11/1977 | Stevenson | 229/75 X |
| 4,185,405 | 1/1980 | Giulie | 40/10 D X |
| 4,366,636 | 1/1983 | Hearsh | 40/159 |
| 4,422,252 | 12/1983 | Wicks | 40/159 |

*Primary Examiner*—William Price
*Assistant Examiner*—Sue A. Weaver
*Attorney, Agent, or Firm*—Kinzer, Plyer, Dorn, McEachran & Jambor

[57] ABSTRACT

A dual purpose pouch, laminated under heat and pressure to provide permanent sealed protection for a permanent identification card and a protective receptacle for a temporary identification card, is cut from a sheet of transparent plastic having a hard, smooth outer surface layer and an inner adhesive layer; the blank comprises a first panel larger than either card, a second panel smaller than the first panel but at least as large as the temporary card, and a third panel of the same size as the first panel, the second and third panels being joined along first and second fold lines to different edges of the first panel. To complete the protective pouch, the permanent card is placed on the adhesive layer of the first panel, the second panel is folded over the permanent card, covering it, the third panel is folded over the second panel, and the resulting folded assembly is laminated under heat and pressure to seal in the permanent card, leaving a protective receptacle for the temporary card intermediate the second and third panels, with access to that receptacle afforded adjacent the first fold line.

16 Claims, 9 Drawing Figures

DUAL PURPOSE POUCHES FOR IDENTIFICATION CARDS

BACKGROUND OF THE INVENTION

It is common practice to seal a driver's license, a student identification card, a hospital identification card, or other similar document between two layers of transparent plastic for purposes of preservation and prevention of alteration. The transparent plastic material most frequently used for this purpose is a sheet material formed in two layers; the first layer is an outer surface film of hard, tough, smooth abrasion-resistant resin and the second is an inner surface layer or coating of a softer thermoplastic resin functioning as an adhesive. Usually, the outer surface layer constitutes a thermoset, biaxially oriented polyester resin and the inner adhesive layer is polyethylene.

A common technique for sealing an identification card into transparent plastic, using a two layer plastic sheet of the kind described, starts with the cutting of a two-panel blank or pouch from the sheet plastic. The two panels of the blank pouch are matched in size and are joined together along one edge by a fold line. It is customary to score or cut the fold line, to a depth less than the total thickness of the plastic sheet, to facilitate folding. The identification card is placed on the adhesive surface of one panel, the other panel is folded over the card, and the resulting assembly is passed through a laminating press. The press applies heat and pressure to the assembly to activate the polyethylene or other adhesive, sealing the two plastic panels to the identification card and to each other, completely encapsulating the card in the sheet plastic. The result is an essentially permanent plastic covering for the identification card that is sealed to preserve the card and to prevent alteration of the card.

In some applications, as in the case of a hospital identification card or an identification card employed for a high security situation, it is desirable to have a temporary or variable identification card associated with a permanent identification card. The requirements for protection of the permanent identification card may be at least as exacting as in the case of a driver's license or other ID card as previously described. For the temporary identification card, it is usually desirable to provide essentially similar protection except that provision must be made for replacement of the variable identification card when required. Thus, in these applications the protective transparent plastic material, in finished form, should provide complete sealed encapsulation of the permanent identification card in a pouch that also affords a receptacle into which the variable ID card may be inserted and in which it is effectively protected.

SUMMARY OF THE INVENTION

It is an object of the present invention, therefore, to provide a new and improved dual purpose pouch of transparent sheet plastic having a configuration and construction such as to afford complete sealed encapsulation of a permanent identification card together with an accessible receptacle for a variable identification card, which may be fabricated from a single sheet of transparent plastic material and which may be fully assembled in sealed condition in a single heat and pressure laminating step.

Accordingly, the invention relates to a dual purpose pouch that is laminatable under heat and pressure to provide permanent, sealed protection for a permanent identification card of width W4 and height H4 and that affords a protective receptacle for a temporary identification card of width W5 and height H5, the pouch being cut from a sheet of transparent plastic having an outer surface layer of hard, tough, smooth abrasion-resistant resin coated with an inner adhesive layer, activatable by heat and pressure to seal contacting portions of the inner layer to each other at levels which do not effect adherence between contacting portions of the inner and outer layers. The pouch comprises a first panel having a width W1 equal to or greater than W4 and a height H1 equal to or greater than H4; a second panel joined to one edge of the first panel along a fold line, the second panel having a width W2 smaller than W1 and greater than W5 and having a height H2 no greater than H1 and greater than H5; and a third panel joined to another edge of the first panel along a fold line, the third panel having a width W3 approximately equal to W1 and having a height H3 approximately equal to H1.

DESCRIPTION OF THE PREFERRED EMBODIMENTS

Figure 1:
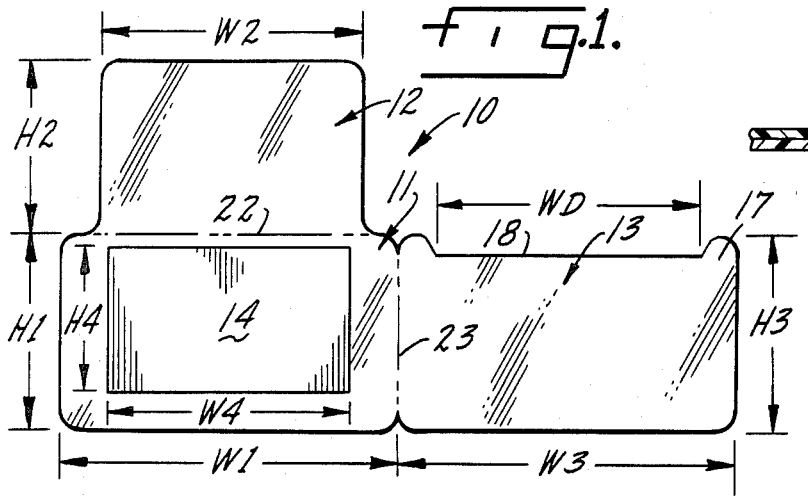
FIG. 1 is a plan view of a laminatable dual purpose pouch according to one embodiment of the present invention as initially cut from a sheet of transparent plastic.
Figure 2:
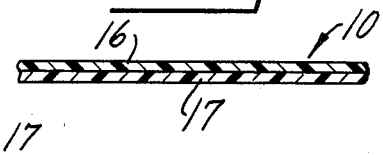
FIG. 2 is a detail sectional view, on an enlarged scale, of the preferred plastic material from which the pouch of FIG. 1 is constructed.

FIG. 1 affords a plan view of a laminatable dual purpose pouch 10 according to one embodiment of the present invention. Pouch 10 is cut from a sheet of transparent plastic having an outer surface layer 16 and an inner surface layer 17, as shown in the sectional view of FIG. 2. The outer surface layer 16 is formed of a hard, tough, smooth abrasion-resistant resin. Preferably, the outer layer 16 constitutes a biaxially oriented polyester resin that functions as a thermoset resin at the temperatures, pressures and feed rates customarily used for lamination of plastic covers for identification cards. That is, the outer surface layer 16 is essentially thermoset for temperatures up to at least 300° F. (149° C.). A preferred polyester resin for the outer surface layer 16 is polyethylene terephthalate rated as having no heat sealability.

The inner surface layer or coating 17 of the sheet from which pouch 10 is cut constitutes a resin that is an effective adhesive activatable by heat and pressure at the levels customarily used for lamination of plastic identification card protection covers. The preferred resin for layer 17 is unoriented polyethylene. The adhesive resin selected for layer 17 should be one which does not effectively adhere to the surface of outer layer 16 when subjected to heat and pressure at the levels ordinarily used for lamination.

Pouch 10, as illustrated in FIG. 1, comprises a first panel 11 having a width W1 and a height H1. Panel 11 is joined at one edge to a second panel 12 along a fold line 22. Panel 12 has a width W2 that is appreciably smaller than the width W1 of panel 11. The height H2 of panel 12 is preferably smaller than the height H1 of panel 11. Fold line 22 is preferably scored or cut, to a depth less than the thickness of the plastic sheet from which pouch 10 is cut, to facilitate folding. A preferred technique for cutting individual segments of the fold line to distinct different levels is described in Rhyner U.S. Pat. No. 4,540,612, may be utilized.

Pouch 10 further comprises a third panel 13 that is joined to another edge of the first panel 11 along a fold line 23. Like fold line 22, fold line 23 should be cut or scored to facilitate folding the two panels 11 and 13 together. Panel 13 has a width W3 and a height H3 approximately equal to the width W1 and height H1 of panel 11, so that the two panels 11 and 13 are effectively matched in size. A shallow indentation 18 is preferably formed in one edge of panel 13.

Pouch 10 is utilized to afford full sealed protection for a permanent identification card 14 having a width W4 and a height H4. In addition, pouch 10, when fully assembled, affords a protective receptacle for a temporary identification card 15 (FIG. 4) of width W5 and height H5.

To assemble pouch 10 with the permanent identification card 14, that card is first aligned on panel 11 in contact with the adhesive layer 17 of the pouch material. The portion of the identification data on card 14 that is most frequently employed should face toward panel 11 because the other side of card 14, facing upwardly in FIG. 1, will subsequently be at least partially obscured by the temporary identification card 15. On the other hand, the surface of the permanent ID card 14 facing upwardly in FIG. 1 may also carry some identification data if desired.

Figure 3:
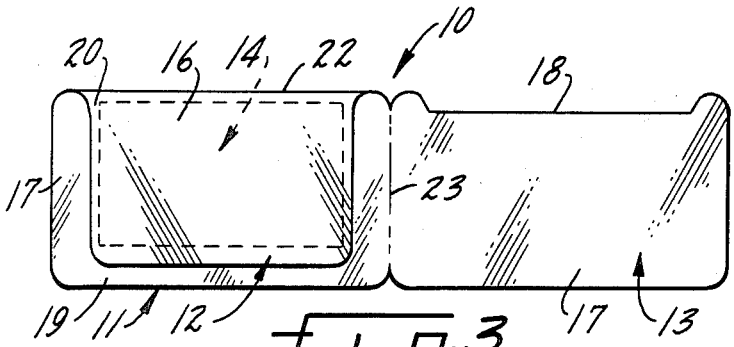
FIG. 3 shows the pouch of FIG. 1 at an intermediate stage of assembly.

The next stage in assembly of pouch 10 is to fold panel 12 downwardly over the permanent identification card 14 and panel 11 to the position shown in FIG. 3. The fold occurs along fold line 22. As seen in FIG. 3, the hard, smooth outer surface layer 16 of panel 12 now faces upwardly; the adhesive layer 17 of panel 12 is in contact with card 14. For a card 14 of the size shown, a small peripheral portion 20 of the adhesive surface of panel 12 is in contact with the adhesive surface of panel 11 around the outer edges of the identification card. Furthermore, a U-shaped edge portion 19 of panel 11 remains exposed around three sides of panel 12.

Figure 5:
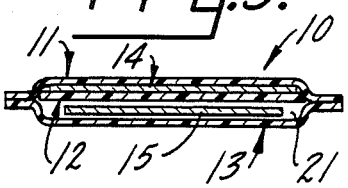
FIG. 5 is a sectional view taken approximately as indicated by line 5—5 in FIG. 4 with the thicknesses of the pouch elements greatly exaggerated.
Figure 4:
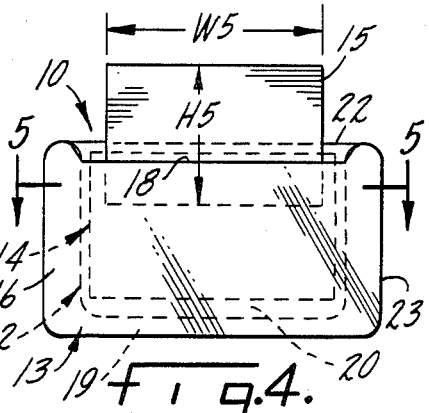
FIG. 4 shows the pouch of FIG. 1 fully assembled.

The third and final stage of manufacture for pouch 10, into a completed laminated assembly, is shown in FIGS. 4 and 5. After panel 12 has been folded down as shown in FIG. 3, panel 13 is folded over panel 12, along fold line 23, to the position shown in FIG. 4. This folding action places the hard, smooth, abrasion-resistant surface 16 of panel 13 on the outside of the assembly. At this stage pouch 10, with the permanent identification card 14 positioned within it, is passed through a conventional lamination press. The heat and pressure applied by the press seal all three of the panels 11-13 together and also seal panels 11 and 12 to the surfaces of identification card 14. In the illustrated embodiment, panels 11 and 12 are sealed to each other all around the outer edges of identification card 14 in the peripheral space 20. Panels 13 and 11 are sealed to each other throughout the U-shaped area 19 around the edges of panel 12. However, because the adhesive layer 17 of the sheet material (FIG. 2) does not adhere to the hard surface layer 16 of panel 12, a receptacle 21 (FIG. 5) is formed between panels 12 and 13. Access to receptacle 21 is facilitated by recess 18 in panel 13, which ends up aligned with fold line 22 (FIG. 4). The temporary identification card 15 is readily insertable into this protective receptacle 21. For maximum protection of card 15, of course, its dimensions W5 and H5 should be smaller than the dimensions H2 and W2 of panel 12.

In pouch 10, the dimensions of all of the panels are shown as being larger than the dimensions for the permanent identification card 14. This is the preferred construction for maximum protection of card 14. However, some variation is permissible. Thus, the width W4 of card 14 may be enlarged so that it is greater than the width W2 of panel 12, so long as that card width W4 does not exceed the width W1 of panel 11. Similarly, the height H4 of card 14 may be equal to or even slightly greater than the heigth H2 of panel 12, though again it cannot exceed and is preferably somewhat smaller than the height H1 of the first panel 11. The preferred construction, however, utilizes dimensions for both panels 11 and 12 that exceed the corresponding dimensions of the permanent identification card 14 to at least some extent so that there is direct resin-to-resin sealing all around the edge of the identification card. To permit insertion of the temporary identification card 15, of course, it is necessary that dimension W2 of panel 12 be somewhat greater than the corresponding dimension W5 for the variable identification card. For maximum protection of card 15, its height H5 should be no greater than the second panel height H2.

Figure 6:
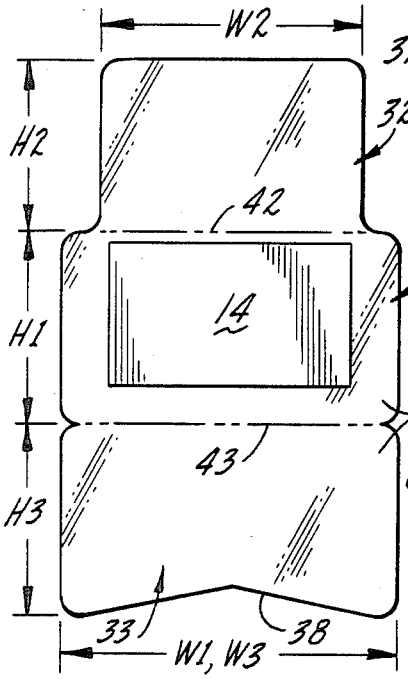
FIG. 6 is a plan view, like FIG. 1, of a laminatable dual purpose pouch in accordance with another embodiment of the invention.
Figure 7:
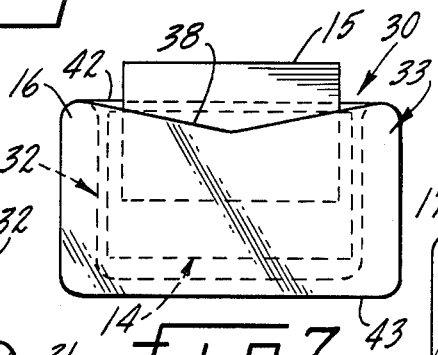
FIG. 7 shows the pouch of FIG. 6 in fully assembled condition.

FIGS. 6 and 7 illustrate a dual purpose pouch 30 according to another embodiment of the present invention. Pouch 30, like pouch 10, is cut from a sheet of transparent plastic (see FIG. 2) having an outer surface layer 16 constituting a film of hard, tough, smooth abrasion-resistant resin coated with an inner adhesive layer 17 that is activatable by heat and pressure at conventional laminating levels which do not affect adherence between the inner and outer layers. Pouch 30 comprises a first panel 31 having a width W1 and a height H1. This first panel 31 is joined to a second panel 32 along a fold line 42, panel 32 having a width W2 and a height H2. A third panel 33 having a width W3 and height H3 is joined to the opposite edge of panel 31 along a fold line 43. Pouch 30 is used in conjunction with a permanent identification card 14 and a temporary identification card 15. The permanent card 14 has a height H4 and width W4 and the temporary identification card 15 has a height H5 and a width W5 as in the previously described embodiment.

The assembly of pouch 30 and its use in relation to the permanent identification card 14 and the variable identification card 15 are essentially the same as described for the first embodiment. Thus, to assemble pouch 30 card 14 is first placed on the adhesive surface 17 of panel 31 in centered alignment to panel 32. Panel 32 is then folded over panel 31 and card 14, along fold line 42, after which panel 33 is folded along line 43 over panels 31 and 32. This achieves the relationship illustrated in FIG. 7. Pouch 30 is then passed through a heat and pressure laminating press, permanently sealing the three panels 31–33 together and encapsulating the permanent identification card 14. As before, the temporary or variable identification card 15 is readily inserted into a receptacle formed between pouch panels 33 and 32. To facilitate insertion and removal of card 15 into the protective receptacle, a recess 38 may be formed in the outer edge of panel 33. As shown, recess 38 ends up in alignment with fold line 42.

In pouch 30, FIGS. 6 and 7, the height H1 of panel 31 and the height H3 of panel 33 should be matched to each other. The width W2 of panel 32 should be smaller than the widths W1 and W3 of the other two panels. It is preferred, though not always essential, that the height H2 of panel 32 be somewhat less than the heights H1 and H3 of panels 31 and 33. Card 14, as shown, preferably has dimensions smaller than any of the three panels 31–33; however, this relationship is not essential and the size of card 14 may be expanded substantially from that shown. Of course, the outer limits for the height and width of the permanent identification card 14 are the dimensions H1 and W1 for panel 31. Card 15, on the other hand, must be small enough to slip into the receptacle formed in the laminated pouch 30, as shown in FIG. 7. Thus, the width W5 for the variable card 15 must be less than the width W2 for panel 32. Preferably, the card height H5 is no greater than H2.

Figure 8:
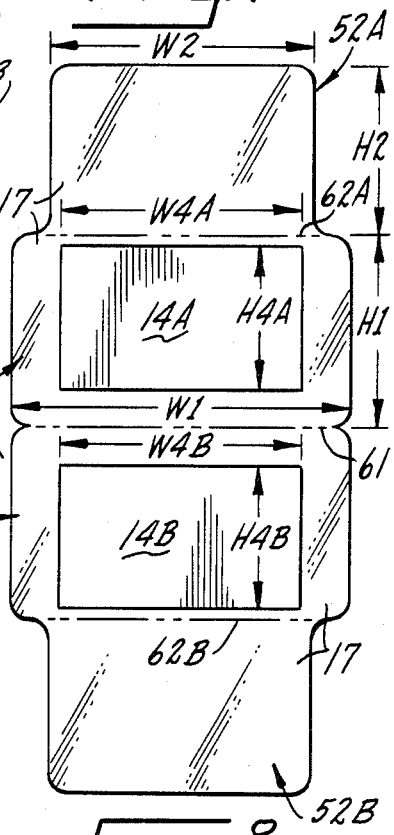
FIG. 8 is a plan view, like FIG. 1, of a laminatable dual purpose pouch according to another embodiment of the invention.
Figure 9:
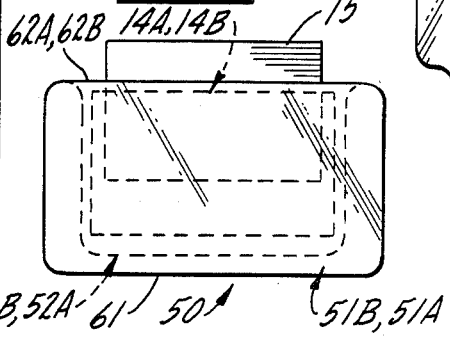
FIG. 9 shows the pouch of FIG. 8 fully assembled.

FIGS. 8 and 9 illustrate a laminatable dual purpose pouch 50 according to yet another embodiment of the invention. The flat blank for pouch 50 (FIG. 8) is again cut from a sheet of transparent plastic having the construction illustrated in FIG. 2, with an outer surface layer 16 of hard, tough, smooth abrasion-resistant resin coated with an inner heat-activatable adhesive resin layer 17 that does not adhere appreciably to layer 16 when subjected to the heat and pressure levels employed in conventional laminating procedures.

Pouch 50 includes a first panel 51A having a width W1 and a height H1. This first panel 51A is joined to a second panel 52A along a fold line 62A that is preferably cut to a depth less than the thickness of the plastic sheet to facilitate accurate folding. Panel 52A has a width W2 that is appreciably smaller than the width W1 of panel 51A and a height H2 that is preferably smaller than the first panel height H1.

The first panel 51A of pouch 50 is also joined to a duplicate first panel 51B along a fold line 61 on the opposite side of panel 51A from fold line 62A. In addition, there is another second panel 52B that is a duplicate of panel 52A. Panel 52B is joined to panel 51B along another fold line 62B.

Pouch 50 is utilized in conjunction with two permanent identification cards 14A and 14B. Identification card 14A has a height H4A and width H4A whereas card 14B has a height H4B and width W4B. The cards are shown as having the same size, but different sized permanent ID cards can be accommodated. In the preferred construction, the two permanent identification cards 14A and 14B are both somewhat smaller than panels 52A and 52B. However, the dimensions of the permanent identification cards 14A and 14B can be enlarged, particularly as to width, from the dimensions illustrated, so long as they do not exceed the first panel dimensions H1 and W1.

To assemble pouch 50, the permanent identification cards 14A and 14B are positioned on the adhesive coating layer 17 of pouch 50 as shown in FIG. 8, in centered alignment to the adjacent panels 52A and 52B. Panel 52A is then folded downwardly over card 14A, along fold line 62A. Similarly, panel 52B is folded up and over card 14B along fold line 62B. The assembly is then folded together along fold line 61 in a manner such that the two second panels 52A and 52B engage each other and the resulting assembly is passed through a conventional laminating press. The heat and pressure applied to the assembly in the press seal the panels together in the relationship illustrated in FIG. 9. In this embodiment of the invention the temporary card 15 is inserted into the pocket formed in the assembly between the hard outer surfaces of the two second panels 52A and 52B. Of course, card 15 must be smaller in width than the width W2 of panels 52A and 52B in order to fit into the protective receptacle at the center of the assembly. The height of card 15 may be made greater than the height H2 of panels 52A and 52B or a tab (not shown) may be provided on the card to facilitate its removal, but these expedients are usually unnecessary.

In the foregoing description of all illustrated embodiments of the invention, the larger dimension of each panel and each card and the larger dimension of the completed pouch assembly has been designated as the width, and the corresponding smaller dimensions have been designated as heights. It should be recognized, however, that this is a purely arbitrary convention and that the reverse relationship is equally applicable.

In pouch 10 the third panel 13 is shown to the right of the first panel 11 and the second panel 12 is positioned above the first panel 11. However, panels 12 and 13 need not be connected by their fold lines 22 and 23 to the illustrated edges of panel 11; rather, the second and third panels can be located along any of the edges of the first panel. Similar variations in the locations of the second panels relative to the first panels can be effected in pouch 50, FIGS. 8 and 9, with the additional caveat that when the pouch panels are folded to their final positions the two fold lines 62A and 62B should be aligned with each other to define the entrance to the receptacle that receives temporary card 15.

In considering the pouch 50 of FIGS. 8 and 9 in relation to the pouches 10 and 30 shown in the earlier figures, it should be recognized that one of the combinations of first and second panels, such as panels 51B and 52B, serve essentially the same purpose in forming the receptacle for the temporary identification card 15 as is provided by the third panels 13 and 33 in the first two embodiments.

I claim:

1. A dual purpose pouch laminatable under heat and pressure to provide permanent, sealed protection for a permanent identification card of width W4 and height H4 and affording a protective receptacle for a temporary identification card of width W5 and height H5, the pouch being cut from a sheet of transparent plastic having an outer surface layer of hard, tough, smooth abrasion-resistant resin coated with an inner adhesive layer, activatable by heat and pressure to seal contacting portions of the inner layer to each other at levels which do not effect adherence between contacting portions of the inner and outer layers, the pouch comprising:

a first panel having a width W1 equal to or greater than W4 and a height H1 equal to or greater than H4;

a second panel joined to one edge of the first panel along a fold line, the second panel having a width W2 smaller than W1 and greater than W5 and having a height H2 no greater than H1;

and a third panel joined to another edge of the first panel along a fold line, the third panel having a width W3 approximately equal to W1 and having a height H3 approximately equal to H1.

2. A dual purpose laminatable pouch according to claim 1 in which the second panel height H2 is smaller than the first panel height H1.

3. A dual purpose laminatable pouch according to claim 2 in which the second panel height H2 is greater than the permanent identification card height H4.

4. A dual purpose laminatable pouch according to claim 3 in which the second panel width W2 is greater than the permanent identification card width W4.

5. A dual purpose laminatable pouch according to claim 1 in which the second panel width W2 is greater than the permanent identification card width W4.

6. A dual purpose laminatable pouch according to claim 1 in which the first panel width W1 is appreciably greater than the permanent identification card width W4.

7. A dual purpose laminatable pouch according to claim 1 in which the first panel height H1 is appreciably greater than the permanent identification card height H4.

8. A dual purpose laminatable pouch according to claim 7 in which the first panel width W1 is appreciably greater than the permanent identification card width W4.

9. A dual purpose laminatable pouch according to claim 1 in which the third panel has an indentation along one side that is aligned with the fold line between the first and second panels when the panels are folded together.

10. A dual purpose laminatable pouch according to claim 1 in which $H1 > H2$;

$H2 > H4$;

$H2 > H5$;

$W2 > W4$;

and the third panel has an indentation along one side that is aligned with the fold line between the first and second panels when the panels are folded together.

11. A dual purpose pouch laminatable under heat and pressure to provide permanent, sealed protection for a first permanent identification card of width W4A and height H4A and a second permanent identification card of width W4B and height H4B, and affording a protective receptacle for a temporary identification card of width W5 and height H5, the pouch being cut from a sheet of transparent plastic having an outer surface layer of hard, tough, smooth abrasion-resistant resin coated with an inner adhesive layer, activatable by heat and pressure to seal contacting portions of the inner layer to each other at levels which do not effect adherence between the contacting portions of inner and outer layers, the pouch comprising:

two matched first panels joined to each other along a common edge constituting a fold line, each first panel having a width W1 equal to or greater than both W4A and W4B and a height H1 equal to or greater than both H4A and H4B;

and two second panels each joined to another edge of a respective one of the first panels, each second panel having a width W2 smaller than W1 and greater than W5 and a height H2 no greater than H1.

12. A dual purpose laminatable pouch according to claim 11 in which the permanent identification card widths W4A and W4B are both appreciably smaller than the first panel width W1.

13. A dual purpose laminatable pouch according to claim 11 in which the permanent identification card widths W4A and W4B are both smaller than the second panel widths W2.

14. A dual purpose laminatable pouch according to claim 11 in which the permanent identification card heights H4A and H4B are both smaller than the second panel heights H2.

15. A dual purpose laminatable pouch according to claim 14 in which the permanent identification card widths W4A and W4B are both smaller than the second panel widths W2.

16. A dual purpose laminatable pouch according to claim 11 in which H2 is at least equal to H5.

* * * * *